US006196884B1

(12) United States Patent
Tanaka

(10) Patent No.: US 6,196,884 B1
(45) Date of Patent: Mar. 6, 2001

(54) FEMALE METAL TERMINAL THAT STABLY CONNECTS WITH MALE METAL TERMINAL

(75) Inventor: Tsutomu Tanaka, Nagoya (JP)

(73) Assignees: Harness System Technologies Research, Ltd., Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/090,399

(22) Filed: Jun. 4, 1998

(30) Foreign Application Priority Data

Jul. 22, 1997 (JP) ..... 9-196125
Jul. 22, 1997 (JP) ..... 9-196127

(51) Int. Cl.[7] ..... H01R 13/187
(52) U.S. Cl. ..... 439/847
(58) Field of Search ..... 439/843, 847, 439/852

(56) References Cited

U.S. PATENT DOCUMENTS 5,217,382 * 6/1993 Sparks ..... 439/161
5,281,175 * 1/1994 Chupak et al. ..... 439/839
5,593,328 * 1/1997 Okada et al. ..... 439/851
5,897,405 * 4/1999 Endo ..... 439/852

FOREIGN PATENT DOCUMENTS

A-58-87789 * 5/1983 (JP) .

* cited by examiner

*Primary Examiner*—Khiem Nguyen
*Assistant Examiner*—Brian S. Webb
(74) *Attorney, Agent, or Firm*—Oliff & Berridge, PLC

(57) ABSTRACT

A female metal terminal includes a terminal body having a contact portion that contacts a tab of a male metal terminal, a pressing member having a spring member that presses the tab against the contact portion, the spring member being mounted on the terminal body, and a movement limitation portion that limits the movement of the tab against the bias of said spring member. A pair of front and rear movement limitation portions may be formed on an upper wall of the terminal body in such a manner that a contact portion of the spring member is disposed between the two movement limitation portions. The tab is inserted into a space between the spring member and the contact portion, and in this condition, even when a tilting force acts on the tab in an upward or a downward direction, the movement of the tab against the bias of the spring member is prevented by the movement limitation portion(s), so that the proper condition of contact between the tab and the contact portion is maintained.

18 Claims, 7 Drawing Sheets

FEMALE METAL TERMINAL THAT STABLY CONNECTS WITH MALE METAL TERMINAL

BACKGROUND OF THE INVENTION

This invention relates to a female metal terminal.

One female metal terminal is disclosed in Unexamined Japanese Patent Publication 58-87789. As shown in FIG. 1, this metal terminal comprises a terminal body 1 having a fitting portion 3 of a square tubular shape extending from a barrel portion 2 for compressively holding a wire (not shown), and a spring piece 4 which is separate from the terminal body 1, and is mounted on the fitting portion 3. A tab 5 of a male metal terminal advances along a lower surface (inner surface) of an upper wall 3A of the fitting portion 3, and is resiliently urged upwardly by the spring piece 4, so that the tab 5 is held in surface-to-surface contact with the upper wall 3A with a predetermined contact pressure.

In the above conventional female metal terminal, the spring piece 4 has a wavy or curved shape, and spaces are formed beneath the tab 5 at the front and rear sides of a peak portion 4A of the spring piece 4 held in contact with the tab 5 (see FIG. 2).

Therefore, when an external force acts on the tab 5 in an upward or a downward direction, the tab 5 is tilted about the peak portion 4A in a seesaw-like manner, so that there is a possibility that the condition of contact between the tab 5 and the upper wall 3A becomes unstable.

SUMMARY OF THE INVENTION

The present invention has been made in view of the above problem, and an object of the invention is to provide a female metal terminal in which the reliability of contact between the female metal terminal and a tab of a male metal terminal is enhanced.

According to the present invention, there is provided a female metal terminal comprising a terminal body having a contact portion for contact with a tab of a male metal terminal, and a spring member for pressing the tab against the contact portion, the spring member being mounted on the terminal body, wherein the terminal body has a movement limitation portion for limiting the movement of the tab against the bias of the spring member. Therefore, even if the tab tries to move against the bias of the spring member, this movement is limited by the movement limitation portion. Therefore, the proper condition of contact between the tab and the contact portion is maintained.

Further, the movement limitation portion is provided at the tab-inserting side disposed forwardly of the spring member. Therefore, when the tab advances from an angle oblique to a longitudinal axis of the female metal terminal, the tab contacts the movement limitation portion before contacting the spring member, so that the tab is prevented from advancing. Namely, the deformation of the spring member due to the oblique striking of the tab against it is prevented.

DETAILED DESCRIPTION OF THE PREFERRED EMBODIMENTS

First Embodiment

Figure 1:
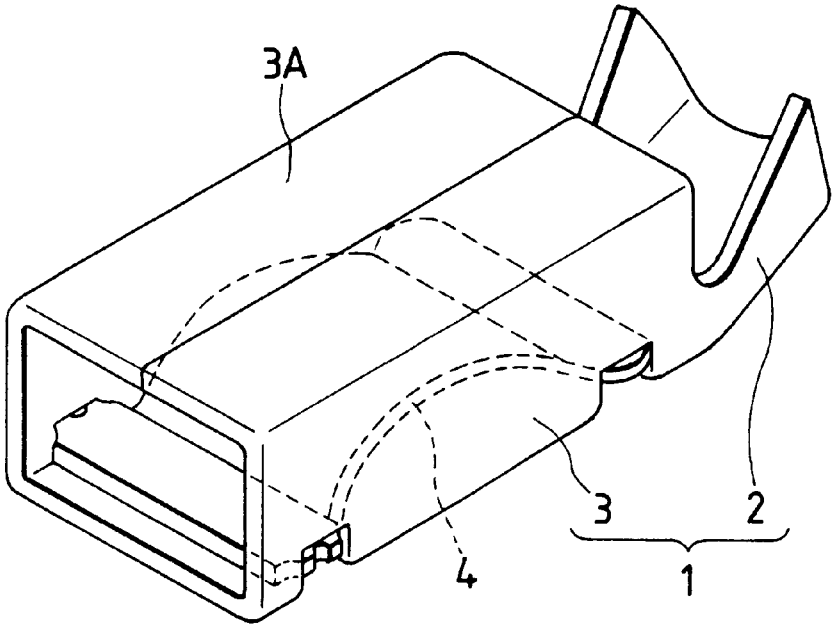
FIG. 1 PRIOR ART
FIG. 1 is a perspective view of a conventional construction.
Figure 2:
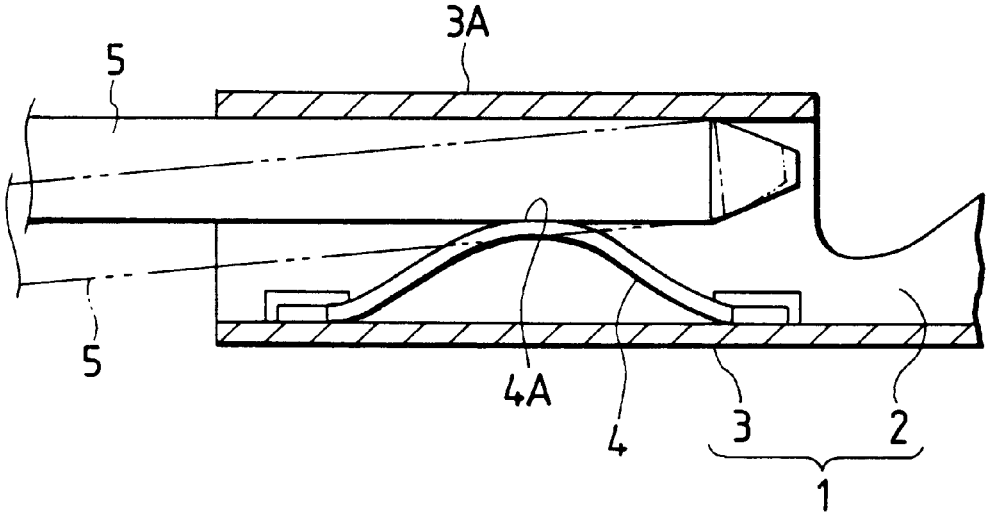
FIG. 2 PRIOR ART
FIG. 2 is a cross-sectional view of the conventional construction.
Figure 3:
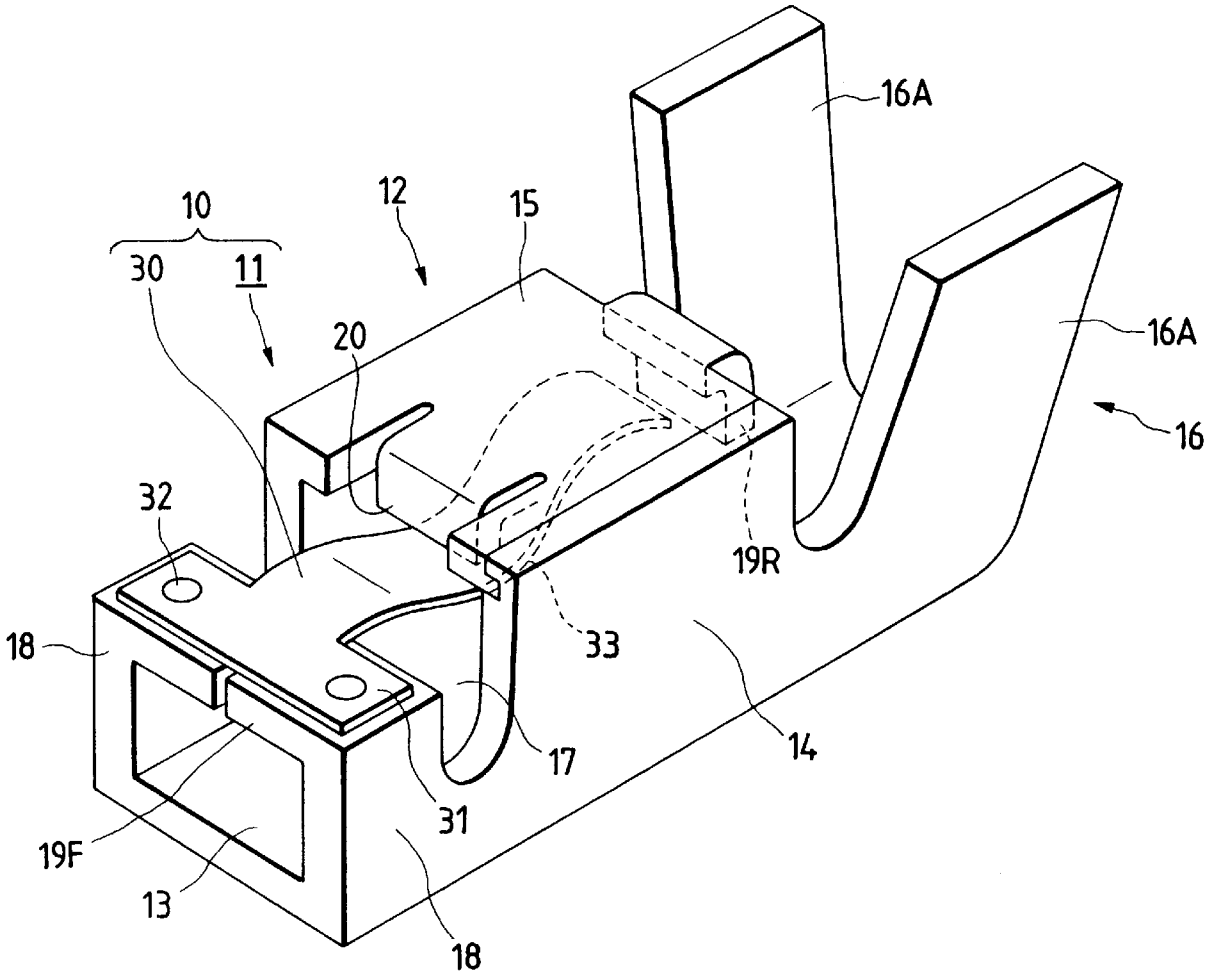
FIG. 3 is a perspective view of a first embodiment.
Figure 4:
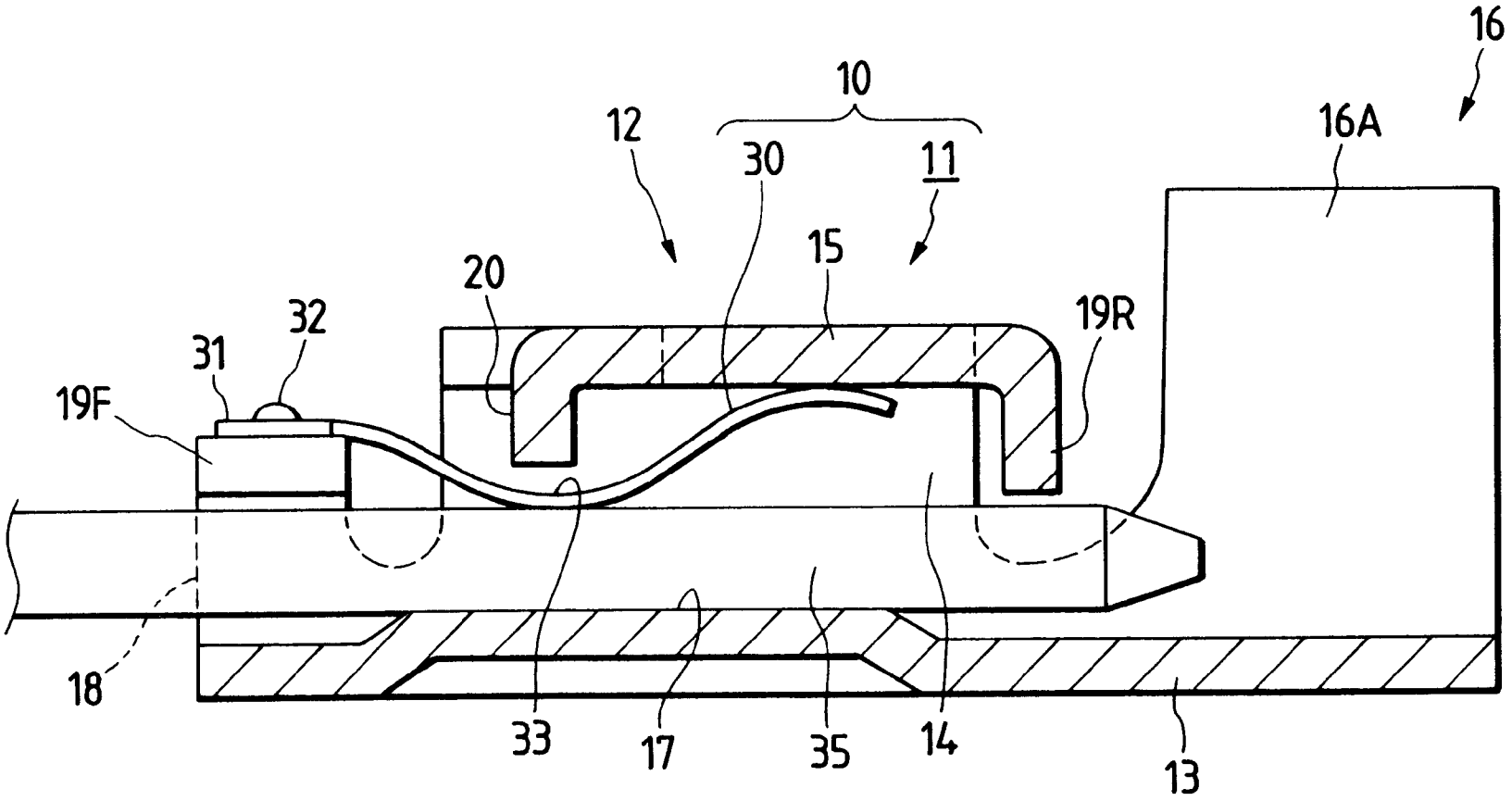
FIG. 4 is a cross-sectional view of the first embodiment.
Figure 5:
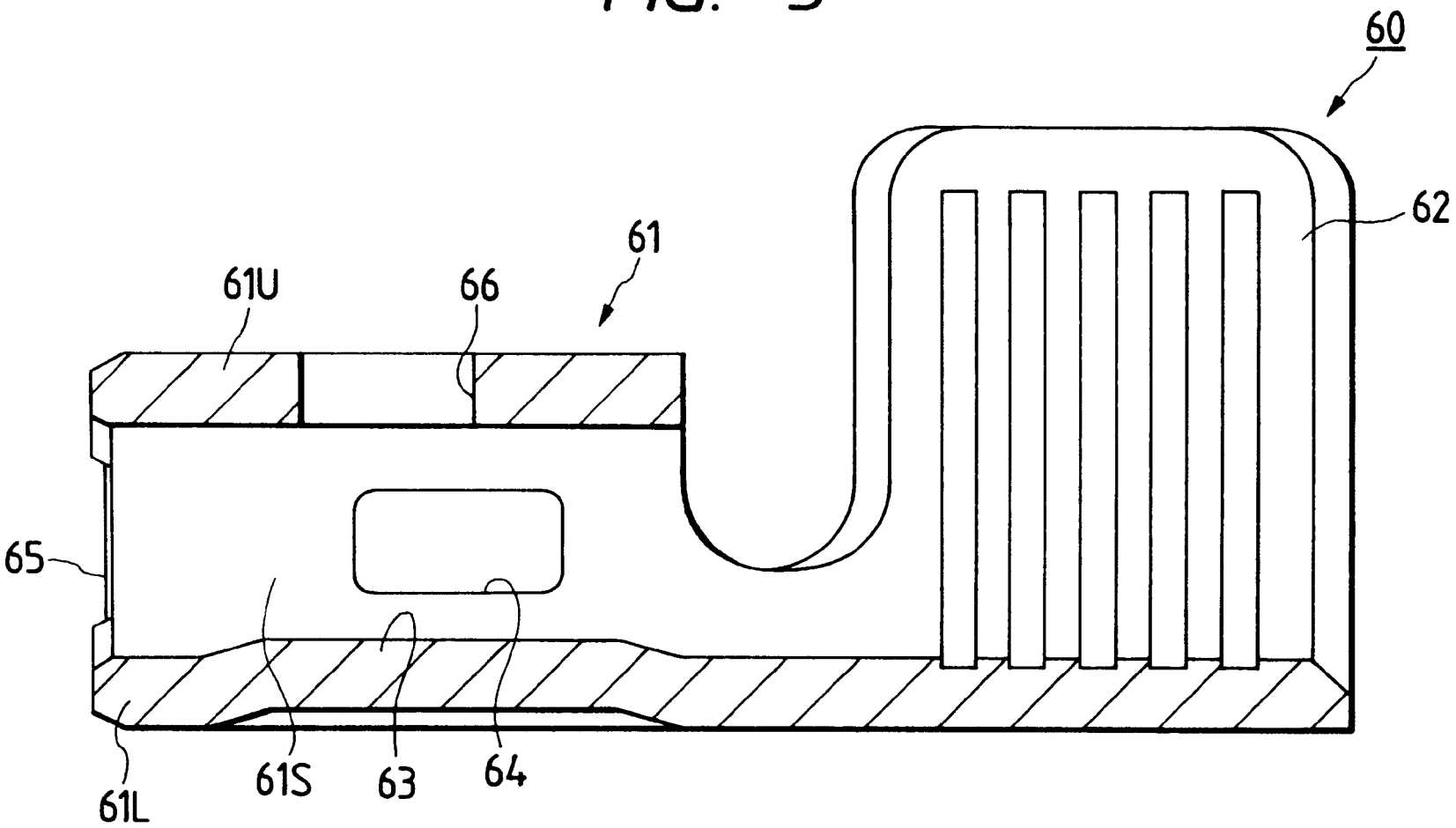
FIG. 5 is a cross-sectional view of a terminal body of a second embodiment.
Figure 6:
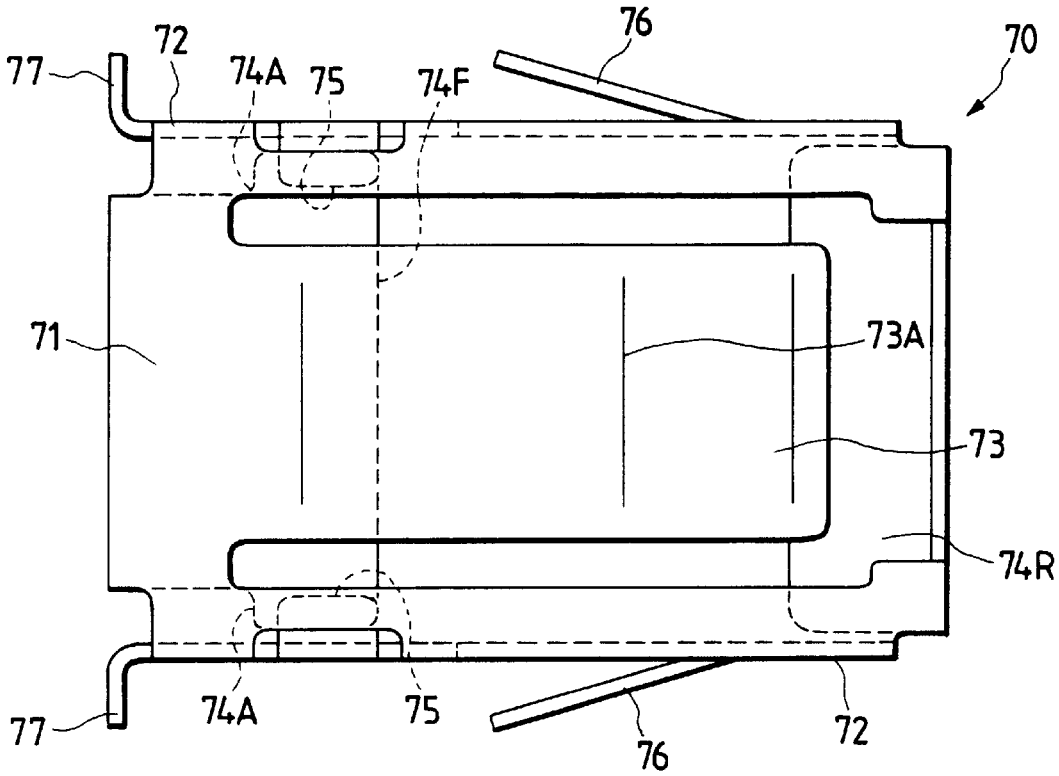
FIG. 6 is a plan view of a pressing member of the second embodiment.
Figure 7:
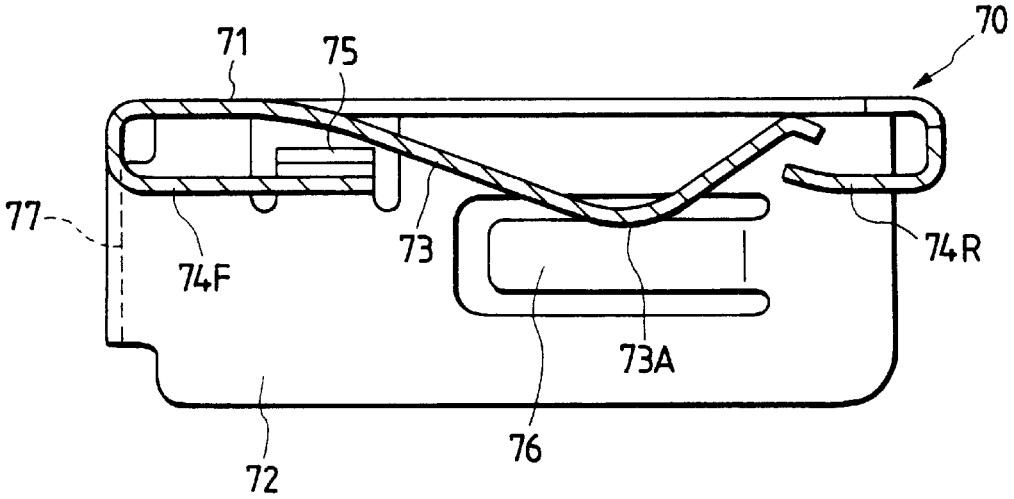
FIG. 7 is a cross-sectional view of the pressing member of the second embodiment.
Figure 8:
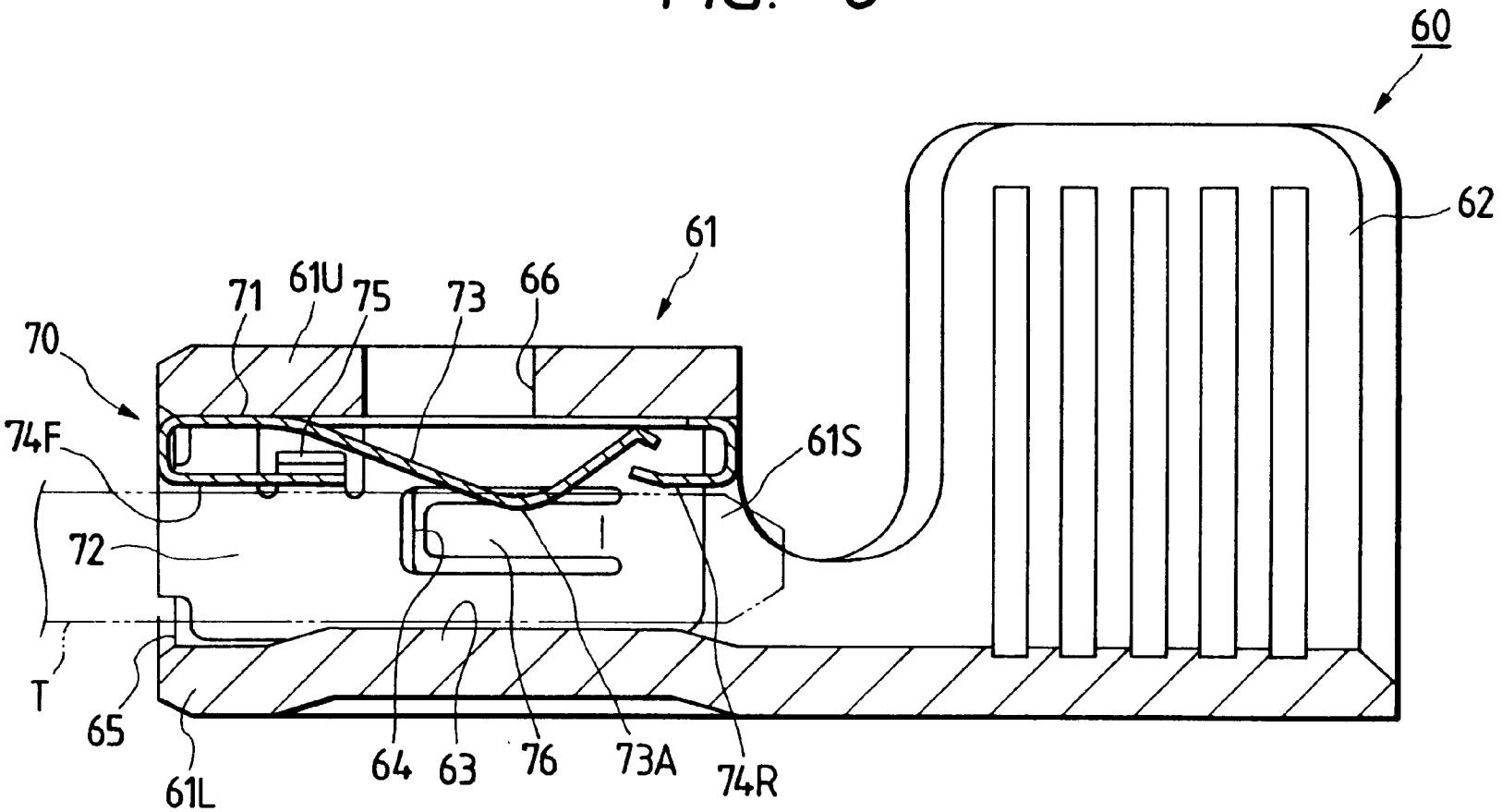
FIG. 8 is a cross-sectional view showing a condition in which the terminal body and the pressing member of the second embodiment are combined together.
Figure 9:
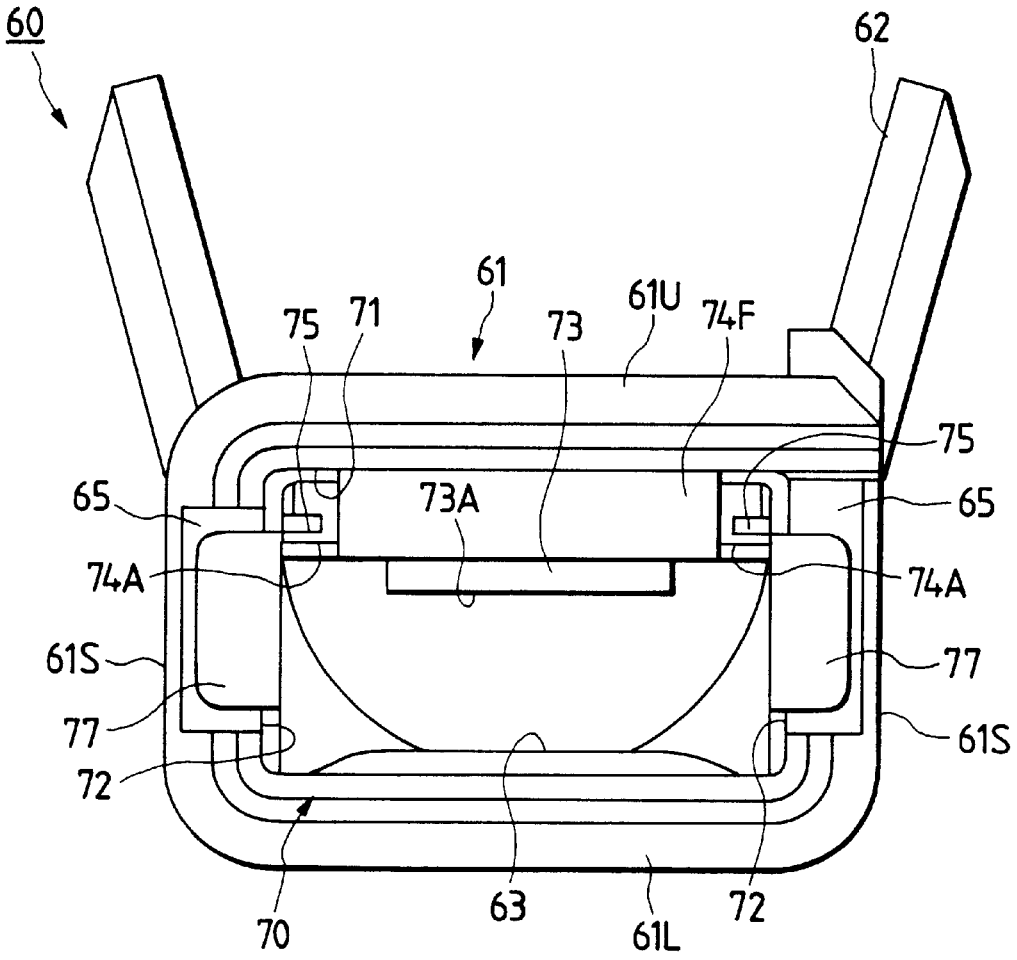
FIG. 9 is a front-elevational view showing the condition in which the terminal body and the pressing member of the second embodiment are combined together.

A first embodiment of the present invention will now be described with reference to FIGS. 3 and 4. A female metal terminal 10 of this embodiment comprises a terminal body 11 and a spring member 30 fixedly secured to the terminal body 11.

The terminal body 11 is formed by bending a metal sheet having a relatively large thickness (for example, 2 mm). A pair of opposite side walls 14 extend upwardly respectively from opposite (right and left) side edges of a lower wall 13 of the terminal body 11 at a longitudinally-central portion of the terminal body 11. An upper wall 15 extends inwardly from an upper edge of one side wall 14, and its distal end edge is held against an upper end of the other side wall 14 thereby forming a tubular fitting portion 12 of a generally square cross-section. A pair of clamping portions 16A extend upwardly respectively from the opposite (right and left) side edges of the lower wall 13 at a rear end portion of the terminal body 11 to form a barrel portion 16 for compressively holding a wire (not shown). A major portion of the lower wall 13 of the fitting portion 12, except its peripheral edge portion, is slightly raised to form a contact portion 17. This contact portion 17 cooperates with the spring member 30 to resiliently hold a tab 35 of a male metal terminal therebetween.

A pair of upstanding portions 18 are formed respectively at the opposite side edges of the lower wall 13 at the front end portion of the terminal body 11, and extension portions extend inwardly respectively from upper ends of the two upstanding portions 18, and are butted together at their distal ends to thereby form a front-side movement limitation portion 19F. The vertical distance between a lower surface of the front-side movement limitation portion 19F and an upper surface of the contact portion 17 is equal to or slightly larger than the thickness of the tab 35.

The spring member 30 is fixedly mounted on the upper surface of the front-side movement limitation portion 19F. The spring member 30 is formed by bending a metal sheet having a thickness (for example, 0.3 mm) smaller than that of the metal sheet constituting the terminal body 11. The spring member 30 extends in the forward-rearward direction, and is curved to bulge downwardly as a whole. A mounting portion 31 of a rectangular shape, which is greater in width than the spring member 30, is formed integrally at the front end of the spring member 30. This mounting portion 31 is fixedly secured by rivets 32 to the upper surface of the front-side movement limitation portion 19F, thus fixedly mounting the spring member 30 to the terminal body 11. In this fixedly-mounted condition, the height or level of a lowermost peak portion 33 (for contact with the tab 35) of the spring member 30 is slightly lower than the lower surface of the front-side movement limitation portion 19F, and the distance between the peak portion 33 and the upper surface of the contact portion 17 is slightly smaller than the thickness of the tab 35. A rear end portion of the spring member 30 is held in contact with the lower surface of the upper wall 15 of the fitting portion 12 or faces this lower surface in closely spaced relation thereto. Namely, when the tab 35 is inserted into the space between the contact portion 17 and the spring member 30, the spring member 30 is resiliently flexed, with its rear end portion pressed against the upper wall 15.

Part of the front end portion of the upper wall 15 is bent downwardly to form an excessive flexure prevention portion 20. This excessive flexure prevention portion 20 is disposed substantially just above the peak portion 33 of the spring member 30, and the lower end of the excessive flexure prevention portion 20 is disposed at a level above the lower surface of the front-side movement limitation portion 19F. Namely, when the tab 35 is properly inserted, the spring member 30 will not contact the excessive flexure prevention portion 20. However, when the flexure of the spring member 30 exceeds a proper range, the peak portion 33 contacts the excessive flexure prevention portion 20, and therefore is prevented from being further flexed, thus preventing the excessive flexure of the spring member 30 beyond its resiliency limit.

An extension portion extends downwardly from the rear edge of the upper wall 15 to form a rear-side movement limitation portion 19R. The height or level of a lower end of this rear-side movement limitation portion 19R is the same as that of the lower surface of the front-side movement limitation portion 19F.

Next, the operation and effects of this embodiment will be described.

When the tab 35 is inserted into the fitting portion 12, the spring member 30 contacts the upper surface of the tab 35, and is resiliently flexed, and the tab 35 is pressed against the contact portion 17 by a resilient restoring force of the spring member 30, so that the tab 35 is held in surface-to-surface contact with the contact portion 17. In this condition, the upper surface of the tab 35 is held in contact with the front-side and rear-side movement limitation portions 19F and 19R, or faces these movement limitation portions in closed spaced relation thereto.

Therefore, even when a tilting force acts on the tab 35 in an upward or a downward direction, the displacement (tilting movement) of the tab 35 is positively limited or prevented by the engagement of the tab 35 with the front-side movement prevention portion 19F or the rear-side movement limitation portion 19R. Therefore, the proper condition of contact between the tab 35 and the contact portion 17 is maintained.

When the tab 35 is to be obliquely upwardly inserted into the fitting portion 12, the tab 35 abuts against the front-side movement limitation portion 19F before the tab 35 contacts the spring member 30, and therefore is prevented from further advancing. Namely, the tab 35 is prevented from striking against the spring member 30 from the obliquely lower side to push the same up, and therefore the deformation of the spring member 30 due to this pushing-up is prevented. The front-side movement limitation portion 19F is formed integrally with the terminal body 11 having a relatively large wall thickness, and has high rigidity, and therefore even if the tab 35 strikes against this movement limitation portion 19F from the front side, this portion 19F will not be deformed.

The present invention is not limited to the embodiment described above with reference to the drawing, and for example, the following embodiments fall within the scope of the present invention, and various modifications other than the following can also be made without departing from the scope of the invention.

In the above embodiment, although the movement limitation portions are disposed respectively on the front and rear sides of that portion of the spring member for contact with the tab, the movement limitation portion may be provided only at the front side (that is, the tab-inserting side) or the rear side.

In the above embodiment, although the front-side movement limitation portion is provided at other portion than the fitting portion, it may be provided at the fitting portion. In this case, the front-side movement limitation portion may be formed by an extension portion extending from the front edge of the upper wall, or by stamping the side walls and by bending these stamped-out portions inwardly, or by forming extension portions extending inwardly from the front edges of the side walls.

In the above embodiment, although the rear-side movement limitation portion is provided at the upper wall of the fitting portion, it may be formed by stamping the side walls and by bending these stamped-out portions inwardly, or by forming extension portions extending inwardly from the rear edges of the side walls. The rear-side movement limitation portion may be formed at other portion than the fitting portion.

In the above embodiment, although the spring member is fixedly secured to the terminal body by the rivets, the spring member may be fixedly secured by other means such as welding, and the spring member may be detachably mounted on the terminal body through retaining and fitting connection so that it can be easily removed from the terminal body.

Second Embodiment

A second embodiment of the present invention will now be described with reference to FIGS. 5 to 9. A female metal terminal of this embodiment comprises a terminal body 60 and a pressing member 70 which are separate from each other, and are combined together.

The terminal body 60 is formed by bending a metal sheet having a relatively large thickness (for example, 2 mm), and this terminal body 60 includes a tubular fitting portion 61 of a rectangular cross-section defined by a front half portion thereof, and a barrel portion 62 for compressively holding a wire (not shown) provided at a rear half portion thereof. A major portion of a lower wall 61L of the fitting portion 61 except a peripheral edge portion thereof is raised to provide a contact portion 63. This contact portion 63 cooperates with a spring piece portion 73 (described later) to resiliently hold a tab T of a male metal terminal therebetween. Retaining holes 64 are formed respectively through opposite (right and left) side walls 61S of the fitting portion 61, and resilient retaining piece portions 76 (described later) of the pressing member 70 are adapted to be retained in the retaining holes 64, respectively. Shallow recesses 65 are formed respectively in opposite (right and left) side edges of a front open end of the fitting portion 61, and retaining pawls 77 of the pressing member 70 are adapted to be retained in the recesses 65, respectively. A lance hole 66 is formed through an upper wall 61U of the fitting portion 61, and when the terminal body 60 is inserted into a cavity in a female connector housing (not shown), a lance (not shown) is engaged in the lance hole 66, thereby holding the female metal terminal within the cavity.

The pressing member 70 is formed by bending a metal sheet having a thickness (for example, 0.3 mm) smaller than that of the metal sheet constituting the terminal body 60. The pressing member 70 has a frame-like configuration having an upper wall 71 and opposite (right and left) side walls 72, and the pressing member 70 is adapted to be fitted into the fitting portion 61. The width of the upper wall 72 and the height of the side walls 72 are substantially equal to the width and height of the interior of the fitting portion 61, respectively, and therefore when the pressing member 70 is received within the fitting portion 61, the pressing member 70 will not move upward, downward, right and left.

A major portion of the upper wall 71 except a peripheral edge portion thereof is stamped out, and is depressed, and is curved in such a manner that its central portion intermediate its front and rear ends bulges downwardly, thereby forming the spring piece portion 73. This spring piece portion 73 projects rearwardly in a cantilever manner within the pressing member 70, and can be resiliently flexed. The spring piece portion 73 can contact the tab T at its lowermost contact portion 73A.

An extension portion, extending from the front end of the upper wall 71, is folded back to be disposed beneath the upper wall 71 in spaced relation thereto, thereby forming a front-side movement limitation portion 74F. This front-side movement limitation portion 74F extends straight rearwardly, and is disposed at a level slightly above the contact portion 73A of the spring piece portion 73. A pair of ear portions 74A are formed on and project from opposite (right and left) side edges of the front-side movement limitation portion 74F, respectively. Upper portions of the right and left side walls 72 are stamped out, and are bent inwardly to form a pair of reinforcement portions 75. The reinforcement portions 75 can engage the upper sides of the ear portions 74A, respectively, so as to positively limit the upward displacement of the front-side movement limitation portion 74F.

An extension portion, extending from the rear end of the upper wall 71, is folded back to be disposed beneath the upper wall 71 in spaced relation thereto, thereby forming a rear-side movement limitation portion 74R. This rear-side movement limitation portion 74R extends straight forwardly, and is disposed at the same level as that of the front-side movement limitation portion 74F.

The pair of right and left resilient retaining piece portions 76 are formed by stamping at those portions of the opposite side walls 72 corresponding respectively to the retaining holes 64. Each of the resilient retaining piece portions 76 projects obliquely outwardly forwardly in a cantilever manner, and can be resiliently flexed inwardly. The pair of retaining pawls 77 extend perpendicularly from the front edges of the opposite side walls 72, respectively, and can be engaged in the recesses 65, respectively.

Next, the operation and effects of this embodiment will be described.

For assembling the female metal terminal, the pressing member 70 is fitted into the fitting portion 61 of the terminal body 60 from the front side thereof. During the fitting of the pressing member 70, the resilient retaining piece portions 76 are brought into contact with the inner surface of the fitting portion 61, and are resiliently flexed inwardly. Then, when the pressing member 70 reaches a proper fitting position, the resilient retaining piece portions 76 are outwardly restored because of their resiliency, and are retainingly engaged respectively in the retaining holes 64, thereby preventing the withdrawal of the pressing member 70. At the same time, the retaining pawls 77 of the pressing member 70 are held respectively against the recessed portions 65 of the terminal body 60 to prevent the further insertion of the pressing member 70. In this manner, the pressing member 70 is mounted on the terminal body 60 against movement in the inserting and withdrawing directions.

In this mounted condition, the distance between the contact portion 63 and each of the front-side movement limitation portion 74F and the rear-side movement limitation portion 74R is equal to or slightly larger than the thickness of the tab T. The tab T is inserted into the fitting portion 61, and is resiliently held between the contact portion 63 and the spring piece portion 73, and in this condition the lower surface of the tab T is held in surface-to-surface contact with the upper surface of the contact portion 63 whereas the upper surface of the tab T contacts the front-side and rear-side movement limitation portions 74F and 74R, or faces these movement limitation portions 74F and 74R in closely spaced relation thereto.

Therefore, even when a tilting force acts on the tab T in an upward or a downward direction, the displacement (tilting movement) of the tab T against the bias of the spring piece portion 73 is positively limited or prevented by the engagement of the tab T with the front-side movement prevention portion 74F or the rear-side movement limitation portion 74R. Therefore, the proper condition of contact between the tab T and the contact portion 63 is maintained.

When the tab T is to be upwardly inserted into the fitting portion 61 at an angle oblique to a longitudinal axis of the female connector, the tab T abuts against the front edge of the front-side movement limitation portion 74F before the tab T contacts the spring piece portion 73, and therefore is prevented from further advancing. Namely, the tab T is prevented from striking against the spring piece portion 73 obliquely from the lower side to push the same up, and therefore the deformation of the spring piece portion 73 due to this pushing-up is prevented. The front-side movement limitation portion 74F is so reinforced by the reinforcement portions 75 that it can not be easily deformed, and therefore even if the tab T strikes against this movement limitation portion 74F from the front side, this portion 74F will not be deformed.

In this embodiment, the pressing member 70 can be mounted on the terminal body 60 merely by fitting the former into the latter, and therefore the efficiency of the assembling operation is excellent.

The front-side and rear-side movement limitation portions 74F and 74R are disposed respectively on the front and rear sides of the spring piece portion 73 (that is, the spring piece portion 73 is disposed between the two movement limitation portions), and the two movement limitation prevention portions 74F and 74R and the spring piece portion 73 are formed on the common pressing member 70, and they are mounted on the terminal body 60 at a time, and therefore the presence of the movement prevention portions 74F and 74R will not affect the mounting of the spring piece portion 73, and in this respect, also, the efficiency of the assembling operation is excellent.

The present invention is not limited to the embodiment described above with reference to the drawing, and for example, the following embodiments fall within the scope of the present invention, and various modifications other than the following can also be made without departing from the scope of the invention.

In the above embodiment, although the movement limitation portions are disposed respectively on the front and rear sides of that portion of the spring piece portion for contact with the tab, the movement limitation portion may be provided only at the front side (that is, the tab-inserting side) or the rear side.

In the above embodiment, although the movement limitation portions extend respectively from the front and rear end of the upper wall of the pressing member, the movement limitation portions may be formed by stamping the side walls and by bending these stamped-out portions inwardly, or by forming extension portions extending inwardly from the front and rear edges of the side walls.

What is claimed is:

1. A female metal terminal comprising:

a terminal body having a contact portion that contacts a tab of a male metal terminal;

a pressing device having a spring member with a pressing portion that presses said tab against said contact portion, one end of said spring member being fixed relative to said terminal body; and at least one movement limitation portion that limits movement of said tab against a bias of said spring member.

2. A female metal terminal as claimed in claim 1, wherein said at least one movement limitation portion is formed in said terminal body.

3. A female metal terminal as claimed in claim 2, wherein said at least one movement limitation portion is provided at least at a tab-inserting side of said terminal body disposed forwardly of the pressing portion of said spring member.

4. A female metal terminal comprising:

a terminal body having a contact portion that contacts a tab of a male metal terminal;

a pressing device having a spring member with a pressing portion that presses said tab against said contact portion, said spring member being mounted on said terminal body; and at least one movement limitation portion that limits movement of said tab against a bias of said spring member, said at least one movement limitation portion being formed in said pressing device.

5. A female metal terminal as claimed in claim 4, wherein said at least one movement limitation portion is provided at least at a tab-inserting side of said pressing device disposed forwardly of the pressing portion of said spring member.

6. A female metal terminal as claimed in claim 1, wherein said terminal body comprises a tubular fitting portion having a rectangular cross-section, and a barrel portion for compressively holding a wire, and one wall of said tubular fitting portion is raised, except a peripheral edge portion, to form said contact portion.

7. A female metal terminal as claimed in claim 6, wherein said at least one movement limitation portion is formed in said terminal body.

8. A female metal terminal as claimed in claim 7, wherein said at least one movement limitation portion is provided at least at a tab-inserting side of said terminal body disposed forwardly of the pressing portion of said spring member.

9. A female metal terminal as claimed in claim 6, wherein said at least one movement limitation portion is formed in said pressing device.

10. A female metal terminal as claimed in claim 9, wherein said at least one movement limitation portion is provided at least at a tab-inserting side of said pressing member disposed forwardly of the pressing portion of said spring member.

11. A female metal terminal as claimed in claim 1, wherein one movement limitation portion is formed at a tab-inserting side of said terminal body, and another movement limitation portion is formed at a rear side of said terminal body, both movement limitation portions limiting movement of said tab against said bias of said spring member.

12. A female metal terminal as claimed in claim 1, wherein a vertical distance between the at least one movement limitation portion and the contact portion is equal to or slightly larger than a thickness of the tab of the male terminal.

13. A female metal terminal as claimed in claim 1, wherein the spring member has a thickness smaller than a thickness of a wall portion of said terminal body.

14. A female metal terminal comprising:

a terminal body having a contact portion that contacts a tab of a male metal terminal;

a pressing device having a spring member with a pressing portion that presses said tab against said contact portion, said spring member being mounted on said terminal body;

a first movement limitation portion formed at a tab-inserting side of said terminal body; and a second movement limitation portion formed at a rear side of said terminal body, wherein the first and second movement limitation portions limit movement of said tab against a bias of said spring member.

15. The female metal terminal as set forth in claim 14, wherein the first and second movement limitation portions are at substantially a same height relative to the contact portion.

16. The female metal terminal as set forth in claim 14, wherein the second movement limitation portion comprises a tab depending from a top wall of said terminal body.

17. The female metal terminal as set forth in claim 14, wherein at least one of the first and second movement limitation portions is formed in said terminal body.

18. The female metal terminal as set forth in claim 14, wherein at least one of the first and second movement limitation portions is formed in said pressing device.

* * * * *